US009770616B2

(12) United States Patent
Chuang

(10) Patent No.: US 9,770,616 B2
(45) Date of Patent: Sep. 26, 2017

(54) ELASTICITY ADJUSTING MECHANISM OF AN EXERCISE EQUIPMENT

(71) Applicant: Lung-Fei Chuang, Taichung (TW)

(72) Inventor: Lung-Fei Chuang, Taichung (TW)

( * ) Notice: Subject to any disclaimer, the term of this patent is extended or adjusted under 35 U.S.C. 154(b) by 126 days.

(21) Appl. No.: 14/927,492

(22) Filed: Oct. 30, 2015

(65) Prior Publication Data

US 2017/0043202 A1 Feb. 16, 2017

(30) Foreign Application Priority Data

Aug. 11, 2015 (TW) ..... 104212948 A

(51) Int. Cl.
*A63B 21/00* (2006.01)
*A63B 21/04* (2006.01)
(Continued)

(52) U.S. Cl.
CPC ..... *A63B 21/04* (2013.01); *A63B 21/00069* (2013.01); *A63B 21/0421* (2013.01); *A63B 21/0442* (2013.01); *A63B 21/055* (2013.01); *A63B 21/0552* (2013.01); *A63B 21/0557* (2013.01); *A63B 21/154* (2013.01); *A63B 21/156* (2013.01); *A63B 21/4017* (2015.10); *A63B 21/4033* (2015.10); *A63B 21/4035* (2015.10); *A63B 21/4043* (2015.10); *A63B 21/4047* (2015.10); *A63B 21/4049* (2015.10); *A63B 22/0012* (2013.01); *A63B 22/0015* (2013.01); *A63B 22/0605* (2013.01); *A63B 23/03516* (2013.01); *A63B 23/03533* (2013.01);
(Continued)

(58) Field of Classification Search
CPC ..... A63B 21/00069; A63B 21/0435–21/0442; A63B 21/154; A63B 21/156
See application file for complete search history.

(56) References Cited

U.S. PATENT DOCUMENTS 6,319,179 B1 * 11/2001 Hinds ..... A63B 21/0552 482/121
6,347,777 B1 * 2/2002 Webber ..... A47C 7/402 248/188.5
(Continued)

FOREIGN PATENT DOCUMENTS

CN 201399188 Y 2/2010
CN 203264148 U 11/2013
(Continued)

*Primary Examiner* — Loan H Thanh
*Assistant Examiner* — Jennifer M Deichl
(74) *Attorney, Agent, or Firm* — CKC & Partners Co., Ltd.

(57) ABSTRACT

The invention discloses an elasticity adjusting mechanism of an exercise equipment which includes a base, a staggered frame, an adjusting socket, an elastic body and force exerting member. The base and the staggered frame pivot with each other and constitute the main structure of the elasticity adjusting mechanism of the exercise equipment. The staggered frame extends outwardly from the base and includes an extended socket and a plurality of fixed portions, the fixed portions are disposed on the staggered frame and with different distances to the extended socket. When the adjusting socket is selectively assembled with one of the fixed portions at different positions, the elastic body passing through the extended socket and the adjusting socket changes its elasticity in accordance with extension amount.

25 Claims, 8 Drawing Sheets

(51) Int. Cl.

| | |
|---|---|
| ***A63B 21/055*** | (2006.01) |
| ***A63B 22/00*** | (2006.01) |
| ***A63B 22/06*** | (2006.01) |
| ***A63B 23/035*** | (2006.01) |
| ***A63B 23/04*** | (2006.01) |
| ***A63B 23/12*** | (2006.01) |

(52) U.S. Cl.
CPC ..... *A63B 23/03541* (2013.01); *A63B 23/12* (2013.01); *A63B 23/1209* (2013.01); *A63B 23/03575* (2013.01); *A63B 23/0476* (2013.01); *A63B 2022/0652* (2013.01); *A63B 2208/0228* (2013.01); *A63B 2208/0233* (2013.01); *A63B 2210/50* (2013.01); *A63B 2225/09* (2013.01); *A63B 2225/10* (2013.01)

(56) References Cited

U.S. PATENT DOCUMENTS

| | | | | |
|---|---|---|---|---|
| 2004/0002412 | A1 | 1/2004 | Kuo | |
| 2007/0161472 | A1* | 7/2007 | Drechsler | A63B 15/00 482/100 |
| 2009/0186749 | A1* | 7/2009 | Zhou | A63B 21/0552 482/140 |
| 2015/0297948 | A1* | 10/2015 | Meister | A63B 23/03566 482/122 |

FOREIGN PATENT DOCUMENTS

| | | | |
|---|---|---|---|
| FR | 2349346 | A1 | 11/1977 |
| KR | 2020080003549 | | 8/2008 |
| MC | 1118 | A | 8/1977 |

* cited by examiner

ELASTICITY ADJUSTING MECHANISM OF AN EXERCISE EQUIPMENT

RELATED APPLICATIONS

This application claims priority to Taiwan Application Serial Number 104212948 filed Aug. 11, 2015, which is herein incorporated by reference.

BACKGROUND

Technical Field

The present disclosure relates to an elasticity adjusting mechanism. More particularly, the present disclosure relates to an elasticity adjusting mechanism of an exercise equipment.

Description of Related Art

Except for fitness equipments, many gymnasiums provide indoor exercise equipments for solving the problem caused by lacking of the space for exercise, such as treadmills, stationary bikes or freewheels.

Among the equipments, bicycles and freewheels can leave one's hands to use other equipments, some of them are provided with elastic ropes, so as to make the exercise more effective and diverse for busy users.

However, there are some barriers for setting elastic ropes caused by the structure of exercise equipments, for example, most of the mentioned equipments are X-shape for easy to storage, but this will limit the area of wiring because elastic ropes are difficult to across the junction of a stationary bike or a freewheel. Consequentially, locations for installing elastic ropes are decreased greatly and inconvenient to vary the tension of elastic ropes. As a result, setting elastic ropes will be invalid to users with different muscle, so that the implicit cost will be generated since these equipments are always idled.

Moreover, another disadvantage is the high replacement rate of elastic ropes. Because the area for wiring is limited, elastic ropes must be shortened. Therefore, compared with longer elastic rope, the shorter one endures much more strain and may be easy to fatigue.

Besides, the locations for installing elastic ropes of exercise equipments in prior art can't be adjusted since they are fixed. According to Hooke's law, the resistance of an elastic rope is proportional to the tensile extension amount, this means the resistance of the elastic rope will be limited since the length of human's arms are finite. That is, when the power of a user's increases, the training effect will get worse. Even if using the thicker or shorter elastic ropes may solve the problem, it is inconvenient and impractical for gymnasiums which provide service to so many users.

SUMMARY

According to an embodiment of the present disclosure, an elasticity adjusting mechanism of an exercise equipment includes a base, a staggered frame, an adjusting socket, a positioning socket, an elastic body and a force exerting member.

The base stands on a ground. The staggered frame includes a front section and a middle section, the middle section has a pivot portion which is pivoted on the base, such that the front section extends outwardly from the base. The front section includes an extended socket. The staggered frame includes a plurality of fixed portions, and the fixed portions are located at different positions of the staggered frame. The adjusting socket is assembled with one of the fixed portions selectively. The positioning socket is disposed on the staggered frame. The elastic body is flexible and disposed on the positioning socket with one end. The extended socket and the adjusting socket are passed by the elastic body. The force exerting member connects to the other end of the elastic body for stretching reciprocately. The adjusting socket selectively is assembled with one of the fixed portions at different positions to change distance between the adjusting socket and the extended socket, and the elasticity of the elastic body is changed in accordance with extension amount.

According to another embodiment of the present disclosure, an elasticity adjusting mechanism of an exercise equipment includes a base, a staggered frame, an adjusting socket an elastic body and a force exerting member.

The base stands on a ground. The staggered frame includes a front section and a middle section, and the middle section connects with the base, such that the front section extends outwardly from the base. The front section includes an extended socket. The staggered frame includes a plurality of fixed portions, and the fixed portions are located at different positions of the staggered frame. The adjusting socket is assembled with one of the fixed portions selectively. The elastic body is flexible and disposed on the adjusting socket with one end. The extended socket is passed by the elastic body. The force exerting member connects to the other end of the elastic body for stretching reciprocately. The adjusting socket selectively is assembled with one of the fixed portions at different positions to change distance between the adjusting socket and the extended socket, and the elasticity of the elastic body is changed in accordance with extension amount.

According to still another embodiment of the present disclosure, an elasticity adjusting mechanism of an exercise equipment includes a base, a staggered frame, an adjusting socket, a positioning socket, an elastic body and a force exerting member.

The base stands on a ground. The staggered frame includes a front section and a middle section, and the middle section connects with the base, such that the front section extends outwardly from the base. The front section includes an extended socket. The staggered frame includes a plurality of fixed portions, and the fixed portions are located at different positions of the staggered frame. The adjusting socket includes at least one movable member which has a withstanding portion. The withstanding portion is assembled with one of the fixed portions selectively. The positioning socket connects with the staggered frame. The elastic body is flexible and disposed on the positioning socket with one end. The extended socket and the adjusting socket are passed by the elastic body. The force exerting member connects to the other end of the elastic body for stretching reciprocately. The adjusting socket selectively is assembled with one of the fixed portions at different positions to change distance between the adjusting socket and the extended socket, and the elasticity of the elastic body is changed in accordance with extension amount.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
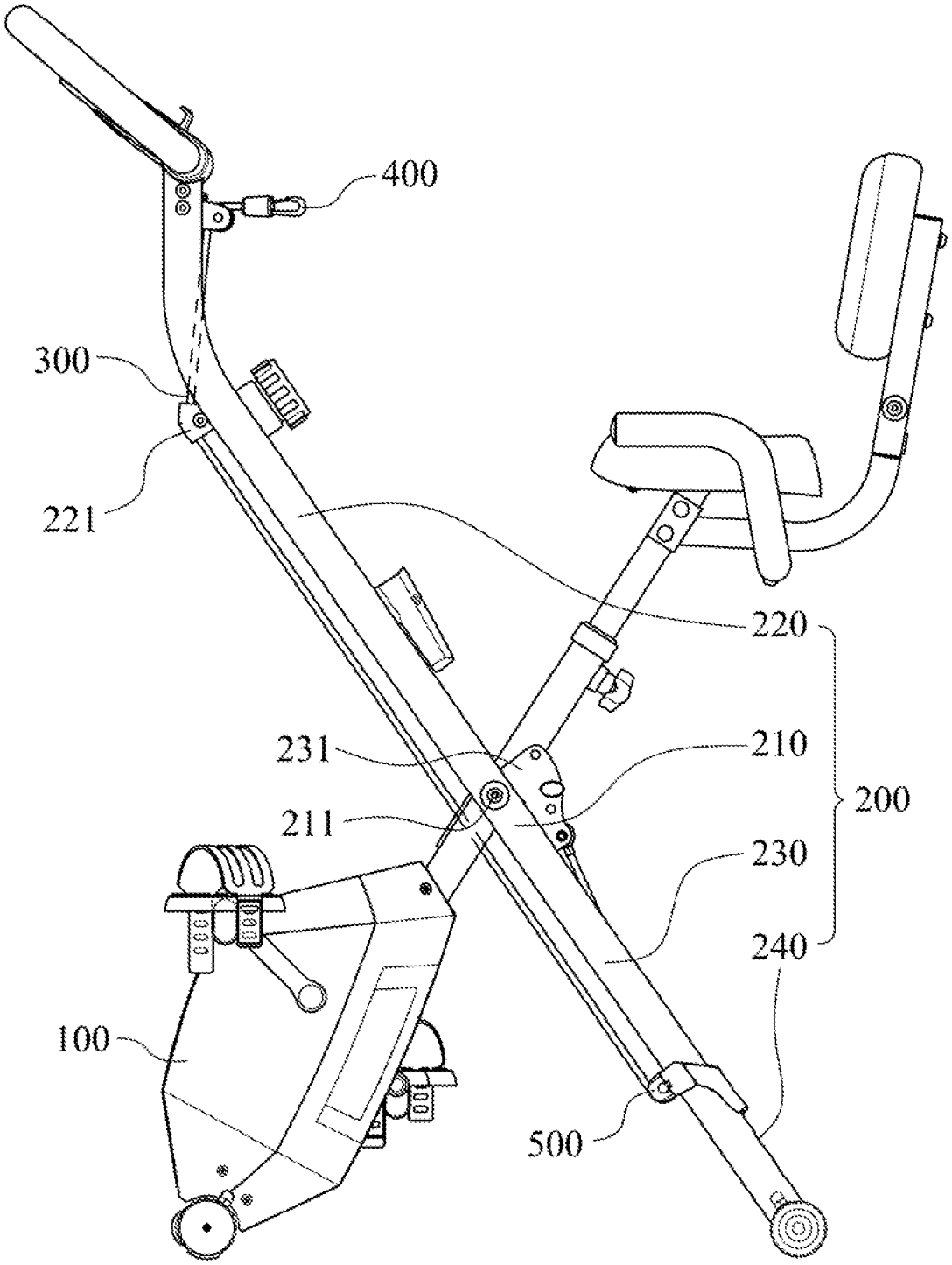
FIG. 1 is a right side view of an elasticity adjusting mechanism of an exercise equipment according to one embodiment of the present disclosure.

FIG. 1 is a right side view of an elasticity adjusting mechanism of an exercise equipment according to one embodiment of the present disclosure. In FIG. 1, the elasticity adjusting mechanism of an exercise equipment includes a base 100, a staggered frame 200, an elastic body 300, a force exerting member 400 and an adjusting socket 500.

As shown in FIG. 1, the base 100 stands on a ground and supports the exercise equipment. The staggered frame 200 includes a pivot portion 211, The pivot portion 211 is as center of the staggered frame 200 can be divided into a middle section 210, a front section 220 and a rear section 230. The pivot portion 211 pivots on the base 100; thereby the staggered frame 200 and base 100 are pivotally connected for forming a foldable frame in X-shape.

In the front of the exercise equipment, the front section 220 includes an extended socket 221. The rear section 230 includes a positioning socket 231, and the positioning socket 231 is pivoted on the staggered frame 200 via the pivot portion 211. Moreover, the positioning socket 231 can be integrated or weld with the staggered frame 200 in different positions.

The elastic body 300 passes through the extended socket 221. The elastic body 300 can be a flexible rope that the elastic force thereof is variable in accordance with extension amount. One end of the elastic body 300 is disposed on the positioning socket 231, and the other end of the elastic body 300 is connected to the force exerting member 400 far stretching reciprocately.

The staggered frame 200 includes a plurality of fixed portions 240. The fixed portions 240 are located at different positions of the staggered frame 200. In one example, the fixed portion 240 can be disposed on the rear section 230 for increasing wining area. The adjusting socket 500 is also passed by the elastic body 300 and is assembled with one of the fixed portions 240 selectively.

Since the positioning socket 231 is fixed on the staggered frame 200, the distance between the adjusting socket 500 and the positioning socket 231 is variable in accordance with the position of the adjusting socket 500. Therefore, the path from the adjusting socket 500 to the force exerting member 400 and the elastic force of the elastic body 300 will be changed, so as to adjust the resistance of the exercise equipment.

Figure 2A:
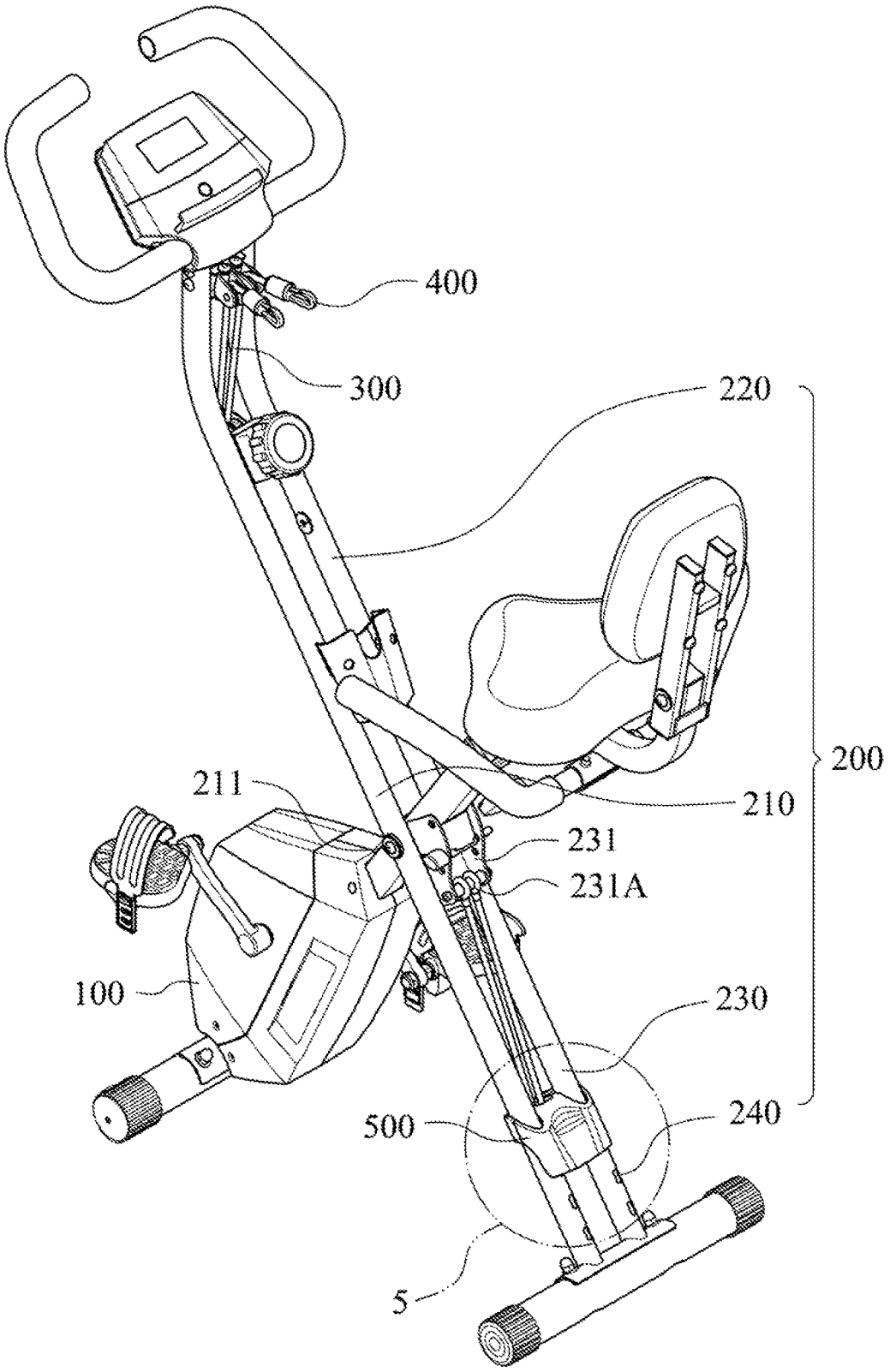
FIG. 2A is a perspective view of the elasticity adjusting mechanism of FIG. 1.
Figure 2B:
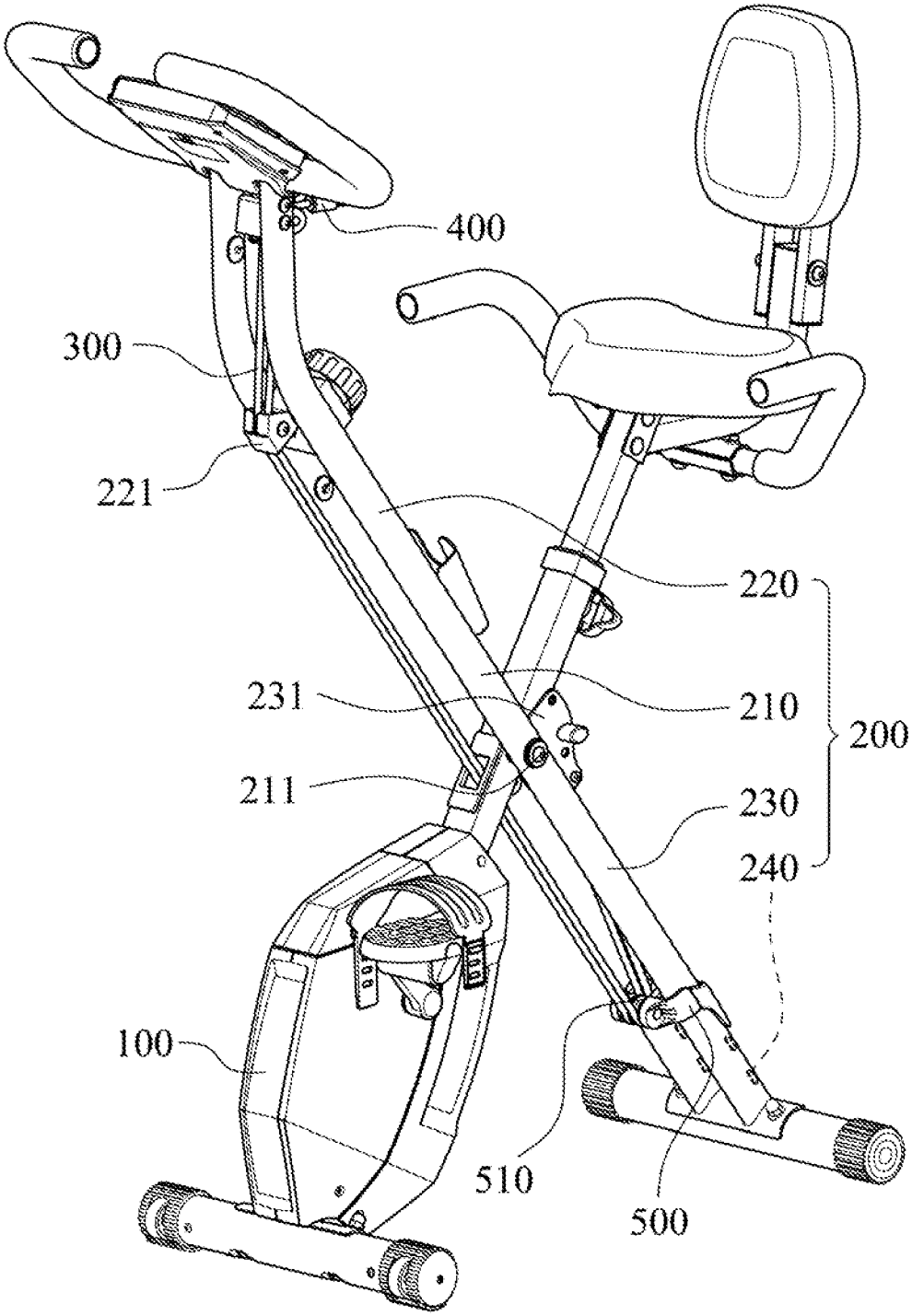
FIG. 2B is another perspective view of the elasticity adjusting mechanism of FIG. 1.

FIG. 2A is a perspective view of the elasticity adjusting mechanism of FIG. 1. FIG. 2B is another perspective view of the elasticity adjusting mechanism of FIG. 1. In detail, the elastic body 300 is arranged in the back of the staggered frame 200, and the base 100 is hollow in position near the pivot portion 211 as shown in FIG. 2B, so that the elastic body 300 can pass through the base 100 and extend continuously.

The adjusting socket 500 can include a pulley 510, and the elastic body 300 can be driven by the pulley 510. The elastic body 300 changes direction thereof and connects to the positioning socket 231 after passing through the pulley 510. Moreover, the elastic body 300 can be further extended through the pulley 510.

Figure 2C:
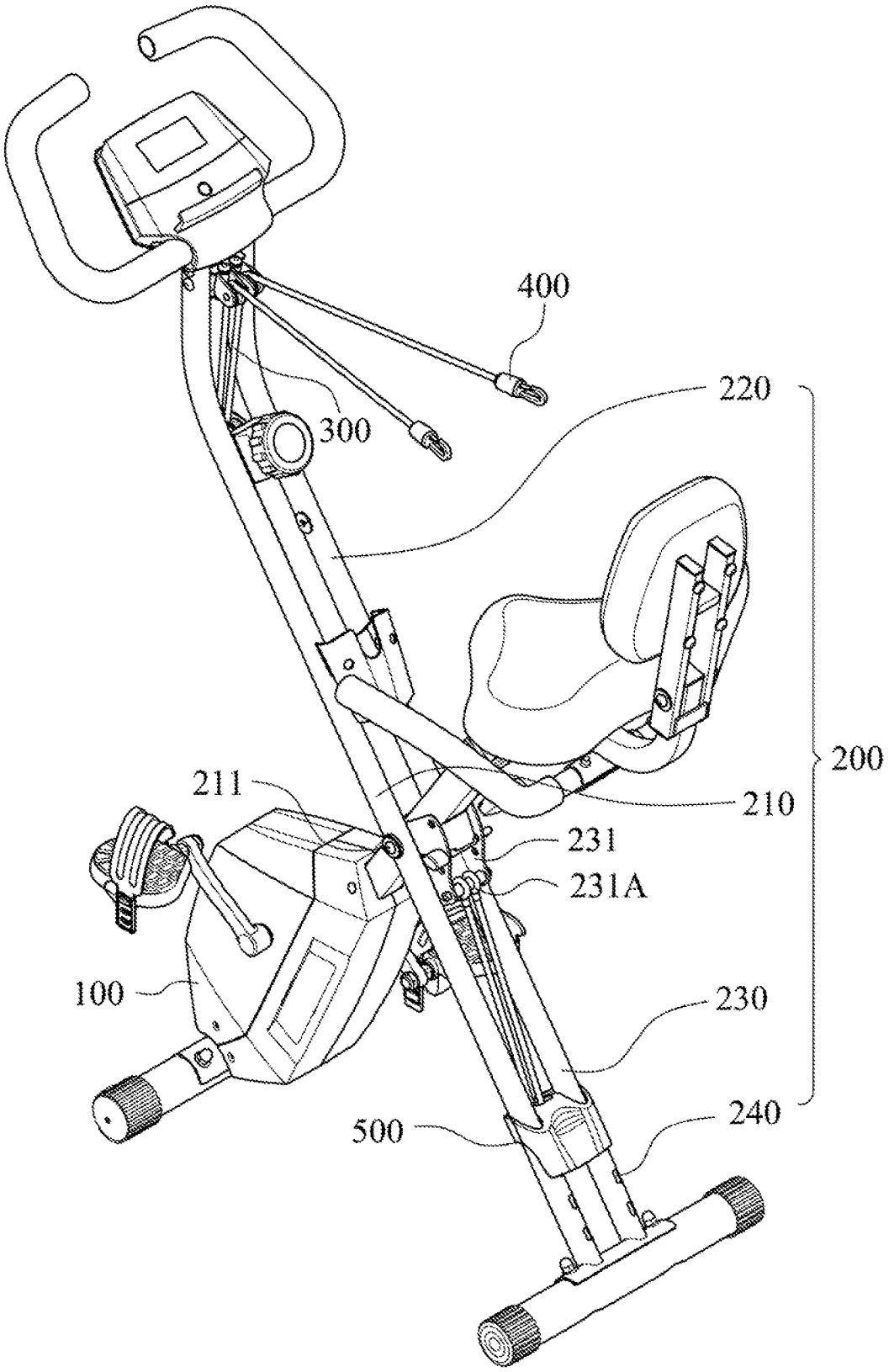
FIG. 2C is a schematic view showing an operation state of the elasticity adjusting mechanism of FIG. 2A.

FIG. 2C is a schematic view showing an operation state of the elasticity adjusting mechanism of FIG. 2A. In FIG. 2C, the positioning socket 231 may rotate slightly when the elastic body 300 is stretched. In one example, the positioning socket 231 can include a pivot member 231A (e.g. a casing) set on the positioning socket 231 that can be driven by the elastic body 300.

Therefore, the pivot 231A can adjust the direction during the rotation with the positioning socket 231 and the elastic body 300, so as to keep the transition of power in straight line for balance and stable when operating the exercise equipment.

Figure 2D:
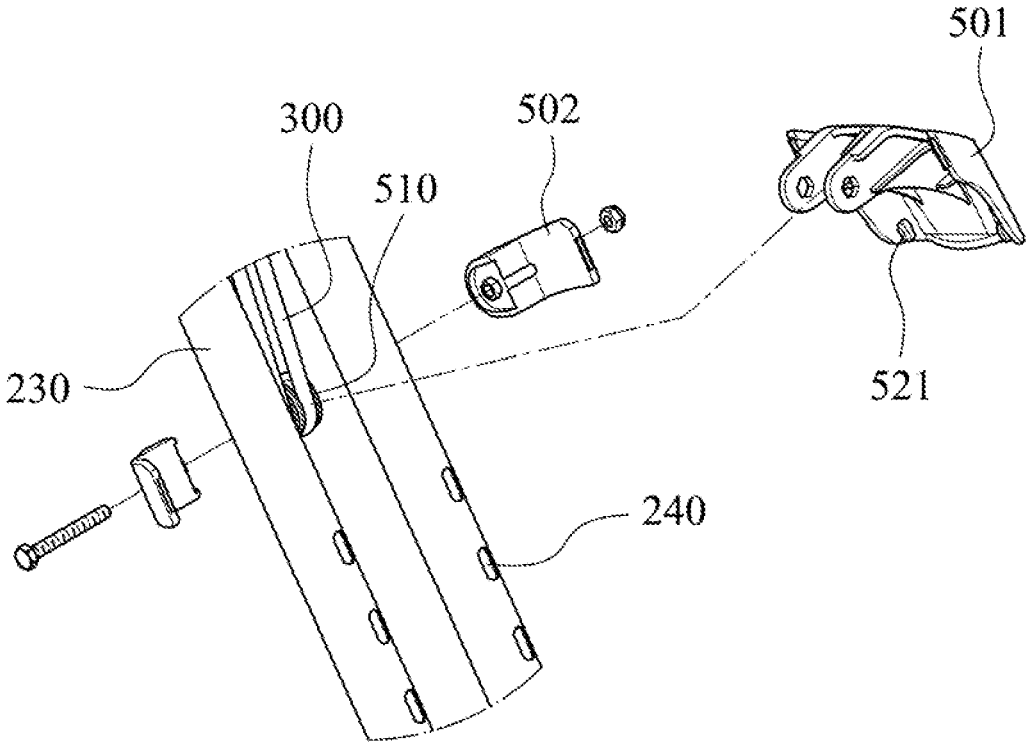
FIG. 2D is an enlarged view of an adjusting socket of the elasticity adjusting mechanism of FIG. 2A.

FIG. 2D is an enlarged view of an adjusting socket of the elasticity adjusting mechanism of FIG. 2A. In FIG. 2D, the adjusted socket 500 includes a combined body 501 and a combined body 502. The combined body 501 and the combined body 502 are screwed with each other, and a withstanding portions 521 in the combined body 501 is locked with the holes of the fixed portions 240. Because the elastic body 300 is tightened the adjusted socket 500 will abut the rear section 230 during the operation. In contrast, when the elastic body 300 is loosened, the withstanding portions 521 can be slightly lifted up by a gap between the adjusted socket 500 and the rear section 230, therefore each of the fixed portions 240 which is fixed with the adjusted socket 500 can be selected by controlling the elastic body 300 and the withstand portions 521.

Figure 3A:
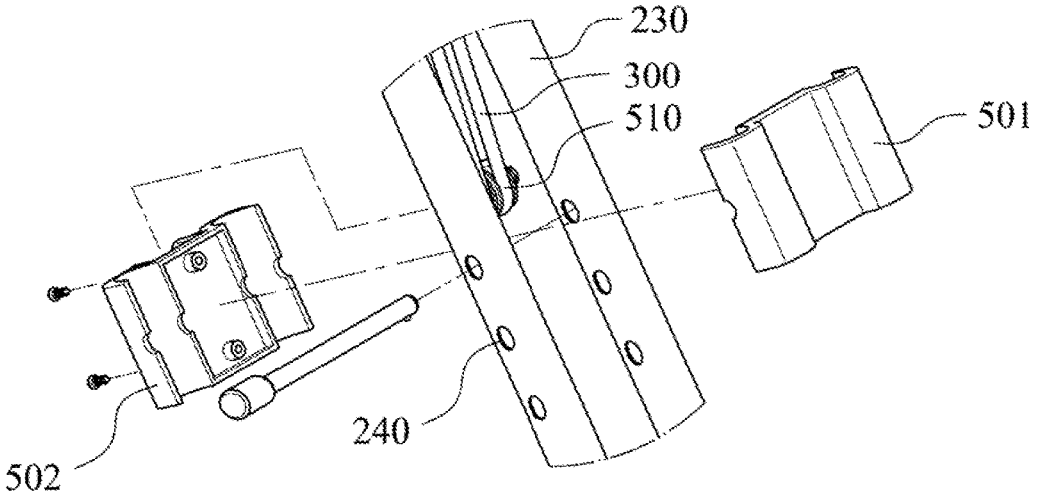
FIG. 3A is an exploded and enlarged view showing a portion of another type of the adjusting socket of the elasticity adjusting mechanism of FIG. 2A.
Figure 3B:
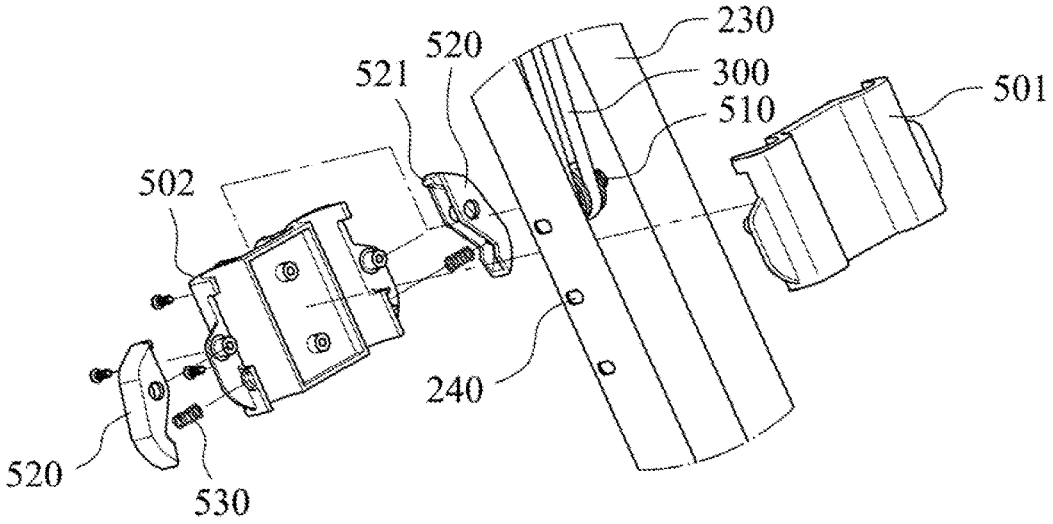
FIG. 3B is an exploded and enlarged view showing a portion of still another type of the adjusting socket of the elasticity adjusting mechanism FIG. 2A.
Figure 3C:
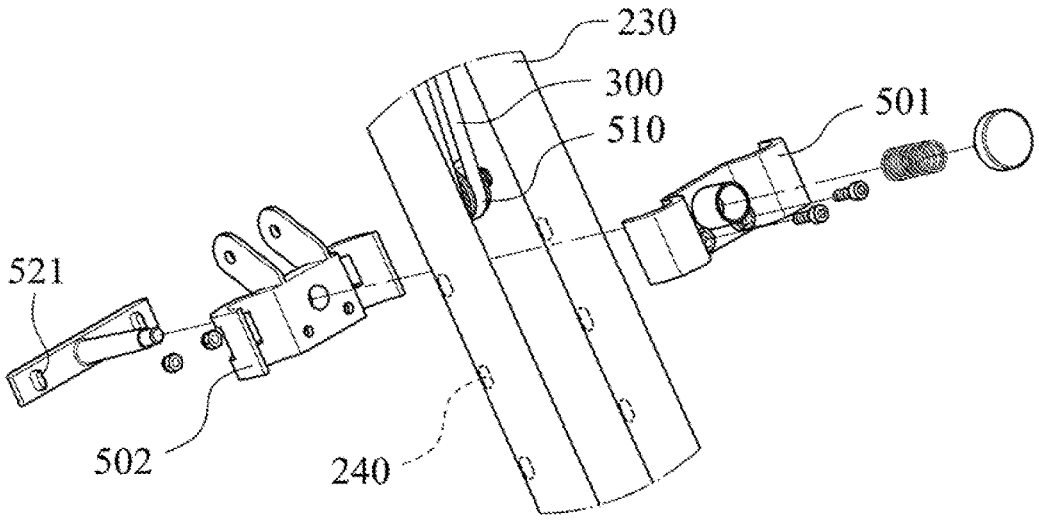
FIG. 3C is an exploded and enlarged view showing a portion of yet another type of the adjusting socket of the elasticity adjusting mechanism of an exercise equipment of FIG. 2A.
Figure 3D:
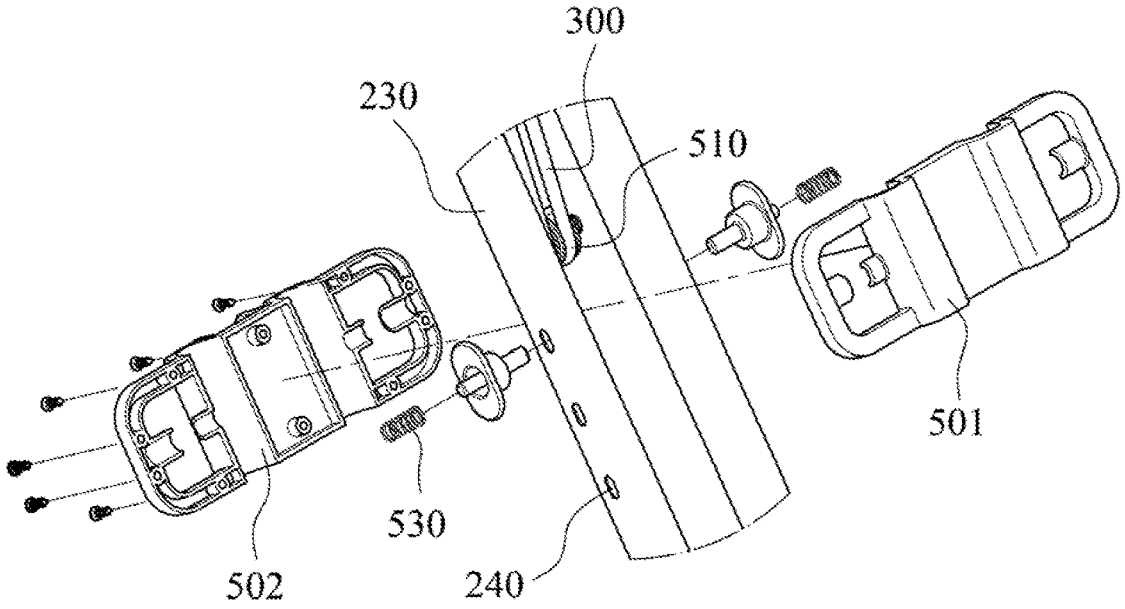
FIG. 3D is an exploded and enlarged view showing a portion of further another type of the adjusting socket of the elasticity adjusting mechanism of an exercise equipment of FIG. 2A.

FIG. 3A is an exploded and enlarged view showing a portion of another type of the adjusting socket of the elasticity adjusting mechanism of FIG. 2A. FIG. 3B is an exploded and enlarged view showing a portion of still another type of the adjusting socket of the elasticity adjusting mechanism FIG. 2A. FIG. 3C is an exploded and enlarged view showing a portion of yet another type of the adjusting socket of the elasticity adjusting mechanism of an exercise equipment of FIG. 2A. FIG. 3D is an exploded and enlarged view showing a portion of further another type of the adjusting socket of the elasticity adjusting mechanism of an exercise equipment of FIG. 2A. In FIG. 3A, FIG. 3B, FIG. 3C and FIG. 3D, various types of the adjusted socket 500 are shown. Other characteristics of the adjusted socket 500 are the same as the aforementioned embodiments, there is on repeating herein.

In FIG. 3A, the fixed portion 240 is composed of two bolt holes. For the convenience of disassembly, the adjusted socket 500 can be formed by combining two combined bodies 501 and 502. The shapes of the combined bodies 501 and 502 are corresponded with the rear section 230, thus the two combined bodies 501 and 502 can be clamped with the staggered frame 200, and then bolted on two sides of the fixed portion 240.

In FIG. 3B, the adjusted socket 500 can include two movable members 520 rotatably and symmetrically disposed at two side of the adjusted socket 500. Each of the movable members 520 has a withstanding portion 521, and the withstanding portion 521 selectively assembles with one of the fixed portions 240. Furthermore, each of the movable members 520 is corresponded to a recovering member 530, and the recovering member 530 extends elastically to push against the movable member 520 when compressed. The recovering member 530 can be a linear spring.

In detail, the recovering members 530 are compressed and extended outwardly, such the movable members 520 won't be taken off from the fixed portion 240. Therefore, a user can change the position of the adjusted socket 500 by holding the movable members 520 to against the elastic force of the recovering members 530. The feature can avoid accident that the adjusted socket 500 shoots up resulting from unlocking the fixing inadvertently.

In FIG. 3C, the combined bodies 501 and 502 are screwed with each other and are bolted by a T-shaped withstanding portion 521. Moreover, the tightness of the withstanding portion 521 can be adjusted by a knob, thereby releasing or fixing the adjusted base 500.

In FIG. 3D, a bolt hole (not labeled) is formed at the assembling surface of the combined bodies 501 and 502 and aligns with the fixed portion 240. After the adjusted socket 500 bolts with the rear section 230, the recovering member 530 pushes and fixes the adjusted socket 500 bolts to the fixed portion 240.

Figure 4:
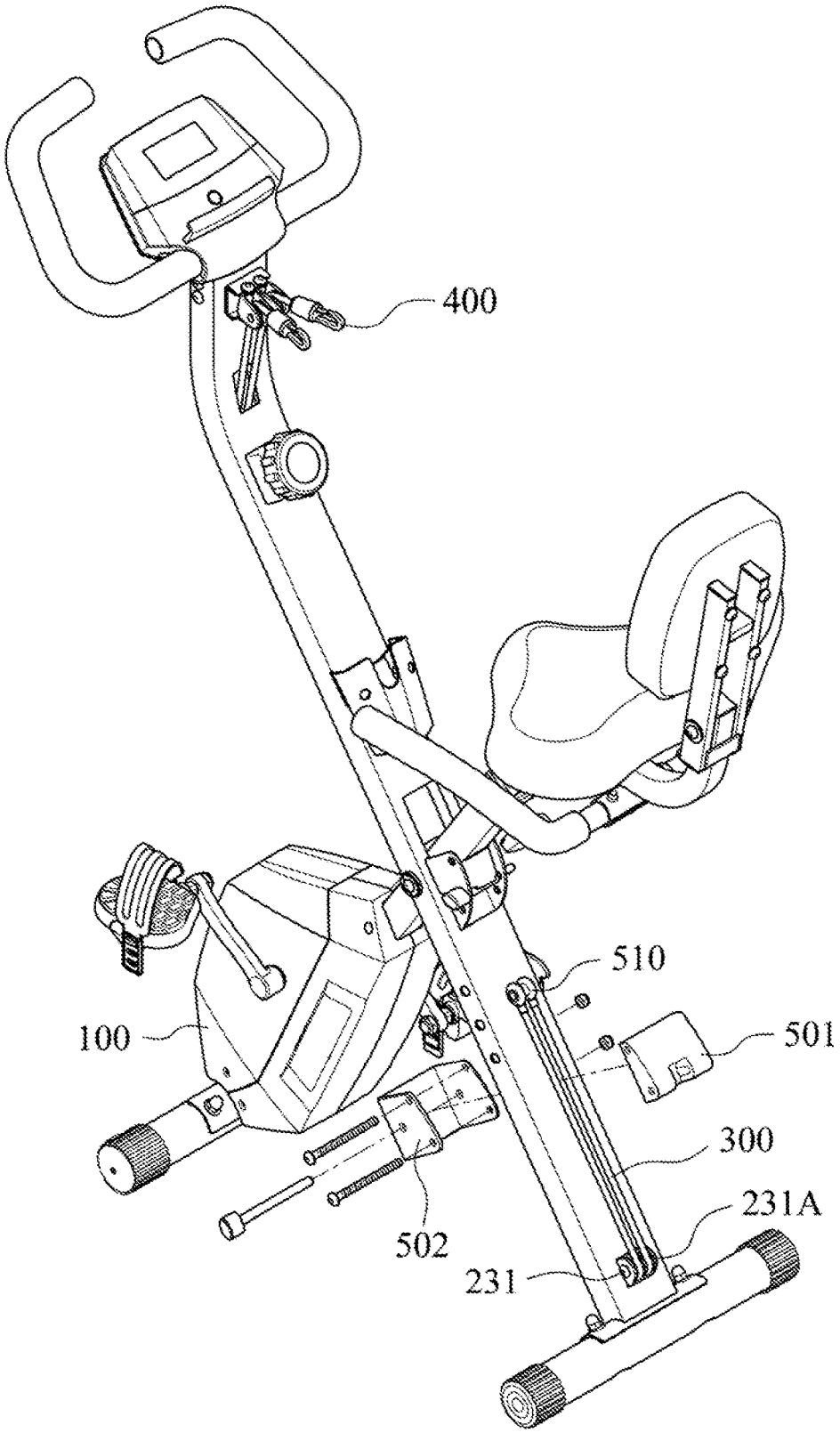
FIG. 4 is an exploded view of the adjusting socket of an exercise equipment according to another embodiment of the present disclosure.

FIG. 4 is an exploded view of the adjusting socket of an exercise equipment according to another embodiment of the present disclosure. In FIG. 4, one end of the elastic body 300 is pivoted to passes through the pulley 510 and pivots the adjusted socket 500, namely, the end of the elastic body 300 is movable. It should be mentioned that the adjusted socket 500 in FIG. 4 is only for description so will not be a limitation. Alternatively, the adjusted socket 500 can be replaced by another one shown in FIG. 3A, FIG. 3B, FIG. 3C or FIG. 3D.

In the case of the above embodiment, the positioning socket 231 is optional because the elastic body 300 connects to the adjusting socket 500. The rear section 230 can be hollow as the first embodiment, or be solid as shown in FIG. 4. The positioning socket 231 is pivoted into the rear section 230 via the pivot member 231A. Also, the pivot member 231A can be replaced by the pulley 510. Therefore, the extension amount of the elastic body 300 is more intuitive. Further, the setting not merely saves space by putting the positioning socket 231 into the rear section 230, but provides the path for the elastic body 300.

According to the foregoing embodiments, the advantages of the present disclosure are described as follows. 1. The elastic body can pass through the hollow base, so as to overcome the problem in limitation for wiring, this makes the size of the elastic body more variable, and improve the training effect. 2. By using the movable adjusting socket, users can adjust the resistance of the exercise equipment, so that avoid the inefficient training or injury caused by unsuitable exercise intensity. More importantly, the feature is favorable for people in business of gymnasiums to manage equipments and save cost because of the high usability of public. 3. The present disclosure provides multi adjusting sockets for different needs so can gives consideration to safety and convenience.

It will be apparent to those skilled in the art that various modifications and variations can be made to the structure of the present disclosure without departing from the scope or spirit of the present disclosure. In view of the foregoing, it is intended that the present disclosure cover modifications and variations of this present disclosure provided they fall within the scope of the following claims.

What is claimed is:

1. An elasticity adjusting mechanism of an exercise equipment, comprising:

a base standing on a ground;

a staggered frame comprising a front section and a middle section, the middle section having a pivot portion pivoted on the base, such that the front section extends outwardly from the base, the front section comprises an extended socket, and the staggered frame comprises a plurality of fixed portions, and the fixed portions are located at different positions on the staggered frame, wherein the staggered frame further comprises a rear section extending backward from the middle section, and the fixed portions are disposed on the rear section;

an adjusting socket selectively assembled with one of the fixed portions;

a positioning socket disposed on the staggered frame;

a flexible elastic body passing through the extended socket and the adjusting socket, and one end of the elastic body being disposed on the positioning socket; and a force exerting member connected to the other end of the elastic body for stretching the elastic body reciprocately;

wherein the adjusting socket selectively is assembled with one of the fixed portions at different positions to change a distance between the adjusting socket and the extended socket, and the elasticity of the elastic body is changed in accordance with an extension amount.

2. The elasticity adjusting mechanism of claim 1, wherein the positioning socket is pivoted on the staggered frame via the pivot portion.

3. The elasticity adjusting mechanism of claim 1, wherein the positioning socket is fixed on the staggered frame integrally.

4. The elasticity adjusting mechanism of claim 1, wherein the adjusting socket further comprises a pulley for sliding the elastic body therethrough.

5. The elasticity adjusting mechanism of claim 4, wherein the elastic body changes direction after passing through the pulley.

6. The elasticity adjusting mechanism of claim 1, wherein the adjusting socket is composed of two combined bodies, and the two combined bodies are clamped with each other and are sleeved on the staggered frame.

7. The elasticity adjusting mechanism of claim 1, wherein a portion of the base is hollow for passing the elastic body therethrough.

8. The elasticity adjusting mechanism of claim 1, wherein the fixed portions are bolt holes, and the adjusting socket bolts with one of the fixed portions selectively.

9. An elasticity adjusting mechanism of an exercise equipment, comprising:

a base standing on a ground;

a staggered frame comprising a front section and a middle section, the middle section connects with the base, such that the front section extends outwardly from the base, the front section comprises an extended socket, and the staggered frame comprises a plurality of fixed portions, and the fixed portions are located at different positions on the staggered frame;

an adjusting socket selectively assembled with one of the fixed portions;

a flexible elastic body passing through the extended socket, and one end of the elastic body being disposed on the adjusting socket; and a force exerting member connected to the other end of the elastic body for stretching the elastic body reciprocately;

wherein the adjusting socket selectively is assembled with one of the fixed portions at different positions to change a distance between the adjusting socket and the extended socket, and the elasticity of the elastic body is changed in accordance with an extension amount;

wherein the staggered frame further comprises a rear section extending backward from the middle section, and a portion of the base is hollow for passing the elastic body therethrough.

10. The elasticity adjusting mechanism of claim 9, further comprising:

a positioning socket disposed on the staggered frame, and the elastic body passes through the positioning socket.

11. The elasticity adjusting mechanism of claim 9, wherein the adjusting socket is composed of two combined bodies, and the two combined bodies are clamped with each other and are sleeved on the staggered frame.

12. The elasticity adjusting mechanism of claim 9, wherein the positioning socket further comprises a pivot member for sliding the elastic body therethrough.

13. The elasticity adjusting mechanism of claim 12, wherein the elastic body changes direction after passing through the pivot member.

14. An elasticity adjusting mechanism of an exercise equipment, comprising:

a base standing on a ground;

a staggered frame comprising a front section and a middle section, the middle section connects with the base, such that the front section extends outwardly from the base, the front section comprises an extended socket, and the staggered frame comprises a plurality of fixed portions, and the fixed portions are located at different positions on the staggered frame, wherein the staggered frame comprises a rear section extending backward from the middle section, and the fixed portions are disposed on the rear section;

an adjusting socket comprising a movable member, the movable member having a withstanding portion, and the withstanding portion selectively is assembled with one of the fixed portions;

a positioning socket connecting with the staggered frame;

a flexible elastic body passing through the extended socket and the adjusting socket, and one end of the elastic body being disposed on the positioning socket; and a force exerting member connected to the other end of the elastic body for stretching the elastic body reciprocately;

wherein the adjusting socket selectively is assembled with one of the fixed portions at different positions to change a distance between the adjusting socket and the extended socket, and the elasticity of the elastic body is changed in accordance with an extension amount.

15. The elasticity adjusting mechanism of claim 14, wherein the middle section comprises a pivot portion, and the positioning socket is pivoted on the staggered frame via the pivot portion.

16. The elasticity adjusting mechanism of claim 14, wherein the positioning socket is fixed on the staggered frame integrally.

17. The elasticity adjusting mechanism of claim 14, wherein the adjusting socket further comprises a pulley for sliding the elastic body therethrough.

18. The elasticity adjusting mechanism of claim 17, wherein the elastic body changes direction after passing through the pulley.

19. The elasticity adjusting mechanism of claim 14, wherein the adjusting socket is composed of two combined bodies, and the two combined bodies are clamped with each other and are sleeved on the staggered frame.

20. The elasticity adjusting mechanism of claim 14, wherein a portion of the base is hollow for passing the elastic body therethrough.

21. The elasticity adjusting mechanism of claim 14, wherein each of the fixed portions is a cavity for fitting with the withstanding portion.

22. The elasticity adjusting mechanism of claim 21, wherein the movable member is corresponded to a recovering member, the recovering member extends elastically to push against the movable member, such that the withstanding portion and the fixed portion fix with each other.

23. The elasticity adjusting mechanism of claim 22, wherein the recovering member is a linear spring.

24. The elasticity adjusting mechanism of claim 22, wherein a number of the recovering member is two, and the two recovering members are symmetrically fixed on two sides of one of the fixed portions.

25. The elasticity adjusting mechanism of claim 14, wherein the movable member is pivoted on the adjusting socket.

* * * * *